United States Patent [19]

Speich et al.

[11] Patent Number: 4,949,762

[45] Date of Patent: Aug. 21, 1990

[54] WEFT GRIPPER FOR SHUTTLELESS LOOM

[75] Inventors: Francisco Speich, Gipf-Oberfrick, Switzerland; Erich Buehler, Rheinfelden/Baden, Fed. Rep. of Germany

[73] Assignee: Textilma AG

[21] Appl. No.: 252,734

[22] Filed: Oct. 3, 1988

[30] Foreign Application Priority Data

Oct. 2, 1987 [CH] Switzerland ..... 3.849/87

[51] Int. Cl.[5] ..... D03D 47/20

[52] U.S. Cl. ..... 139/445

[58] Field of Search ..... 139/443–449

[56] References Cited

U.S. PATENT DOCUMENTS

| | | | |
|---|---|---|---|
| 2,837,124 | 6/1958 | Ancet et al. | 139/445 |
| 3,441,061 | 4/1969 | Peracca et al. | 139/448 |
| 3,857,419 | 12/1974 | Mackie | 139/448 |
| 3,927,699 | 12/1975 | Volpe | 139/448 |
| 3,998,251 | 12/1976 | Hadam | 139/448 |
| 4,127,150 | 11/1978 | Steverlynck | 139/449 |

FOREIGN PATENT DOCUMENTS

| | | |
|---|---|---|
| 0266286 | 5/1988 | European Pat. Off. . |
| 2344123 | 3/1974 | Fed. Rep. of Germany . |
| 2536022 | 2/1977 | Fed. Rep. of Germany . |
| 3512303 | 6/1986 | Fed. Rep. of Germany . |
| 2214773 | 8/1974 | France . |
| 1116907 | 6/1968 | United Kingdom . |

*Primary Examiner*—Andrew M. Falik

*Attorney, Agent, or Firm*—Toren, McGeady & Associates

[57] ABSTRACT

A gripper loom comprises a filing thread insertion device with a gripper (2), which contains a clamp or clip (16) for a filling thread (8) that is releasable by an opener. An adjustment apparatus (28) is provided for setting up the spacing (X) of the open position of the clip or clamp at the filling thread pullout side of the shed (6) or the selvage (43). The adjustment apparatus (28) is actuatable during the operation of the gripper loom. For this purpose, the adjustment apparatus contains, for instance, a pivotable control strip (32) which cooperates with a stop cam (26) of the clip or clamp.

11 Claims, 1 Drawing Sheet

WEFT GRIPPER FOR SHUTTLELESS LOOM

FIELD AND BACKGROUND OF THE INVENTION

The present invention relates in general to weaving machines and, in particular, to a new and useful gripper loom having a gripper with movable thread clip and adjustment means for adjusting the position at which the clip is moved to release a filling thread held by the clip to the gripper.

Gripper looms are known in great numbers. For example, German DE-OS 23 44 123 discloses grippers that are pushed into or again pulled out from a shed in a positively locking manner One differentiates between gripper looms with single-sided grippers and gripper looms with double-sided grippers, wherein single-sided grippers pass through the entire shed. In the case of two-sided grippers, a gripper is brought into the shed from each side of the fabric, wherein one gripper as a supplier pulls in a filling thread from one side and delivers it in the center of the shed to the picker-gripper. The picker-gripper then pulls the filling thread completely out of the shed.

SUMMARY OF THE INVENTION

It is the task of the present invention to improve such gripper looms to such an extent that the spacing of the open position of the gripper from the shed or the selvage to the release of the filling thread after pulling the filling thread through the shed is adjustable during operation of the gripper loom.

Accordingly, an object of the present invention is to provide a gripper loom which comprises a gripper which is movable to insert a filling thread into the shed formed by warp threads, a clip mounted for movement to the gripper for holding a filling thread to the gripper, opening means connected to the clip for moving the clip with respect to the gripper for releasing the filling thread and an adjustment device for adjusting the spacing between the gripper and the warp threads at which the opening means is activated for moving the clip to release the filling thread.

It is thus made possible to adjust the spacing of the open position of the clip or grip from the shed or the selvage, after pulling the filling thread through the shed, to the respective operational positions by means of the adjustment device. Thus, it is for instance possible to provide the open position at a greater spacing from the shed during stoppage or extra slow speed of the gripper loom and to advance said open position nearer to the shed during operation, for instance, as a function of the rpm and indeed in such a way that the spacing can be reduced to the minimum possible.

A particularly simple embodiment of the invention provides a pivotable control strip which coacts with a stop cam on the clip to provide the adjustment means or device. The control strip may alternatively be mounted for linear movement in the direction of movement of the gripper, and include an inclined stop cam which cooperates with the stop cam of the clip for adjusting the position at which the clip is moved to release the filling thread. Various possibilities exist for providing the mechanism for moving the control strip, whether it is pivotally mounted or mounted for linear movement.

Control of the adjustment device can now occur individually in a manual fashion or automatically, by designing the adjustment device according to different embodiments the invention. Automatic control is especially advantageous.

The adjustment device is suitable for gripper looms with one-sided grippers as well as for gripper looms with two-sided grippers.

A still further object of the present invention is to provide a gripper loom which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its use, reference should be had to the drawings and descriptive matter in which there are illustrated and described the preferred embodiments of the invention.

DESCRIPTION OF THE PREFERRED EMBODIMENTS

Figure 1:
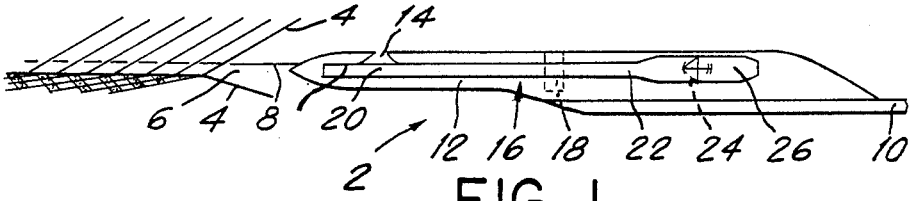
FIG. 1 is an elevational view of a picker-gripper after leaving the shed from the loom stand.
Figure 2:
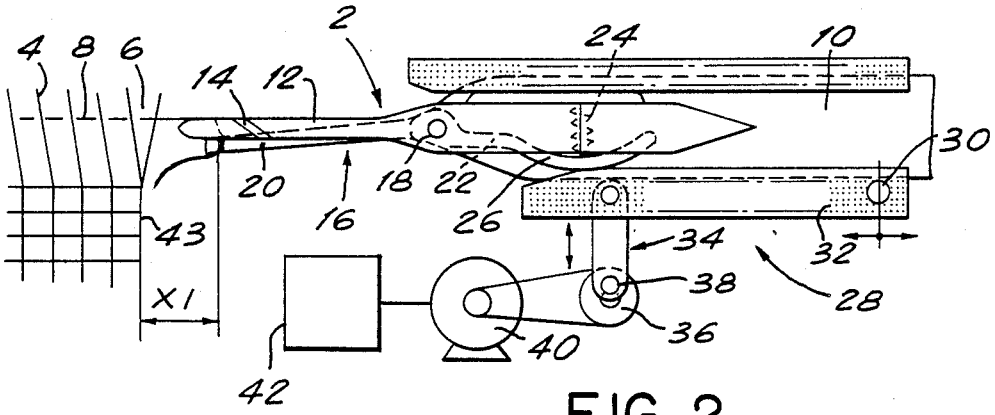
FIG. 2 is an elevational view of the picker-gripper in FIG. 1, in its early open position.
Figure 3:
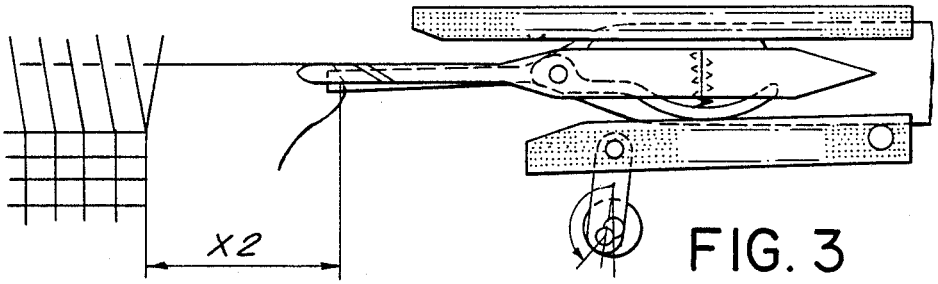
FIG. 3 is a view similar to FIG. 2 of the picker-gripper in FIG. 1, in a late open position.

FIGS. 1 to 3 show a picker-gripper 2 of a gripper loom with two filling thread insertion devices, that is two-sided grippers, after leaving a shed 6 formed by warp threads 4, through which the picker-gripper 2 has just pulled a filling thread 8. The picker-gripper 2 is fastened at an insertion or picking band 10 and contains a receiving slot 14 for the filling thread 8 at its lance-shaped portion 12. In order to prevent unintended sliding out of the filling thread 8, a clip or clamp 16 is provided which is pivotable around a bolt 18 which comprises a clip arm 20 cooperating with the receiving slot 14. The clip 16 comprises an additional arm 22 at its end facing away from the clip arm 20 which is biased into a clipping or clamping position, by means of a spring 24. THe arm 22 forms a stopping cam 26 which cooperates with an opener or adjustment device 28, for opening the clip.

The adjusting device 28 comprises a control strip 32 that is pivotable around a bolt 30 and which cooperates with a stopping cam 26. The inclination or slope of the control clip 32 and with this the open position of the clip can be determined an eccentric drive 34. The eccentric lug 38 arranged on a disk 36, can be actuated either manually or by means of an electromotor 40. The electromotor is connected to a control apparatus 42 which, for instance, can be the switching arrangement of a main motor and/or of a very slowly operating motor for the remaining aggregates of the gripper loom or which can be a control apparatus equipped with a microprocessor of the gripper loom. This adjustment apparatus can effect the open position of the clips at an early time, that is, with a short spacing X1, from the shed or the selvage 43, when the control strip lies practically parallel to the operational position of the picker-gripper according to FIG. 2. On the other hand, if the control strip has an inclination the operational position of the picker-gripper shown in FIG. 3, then there results a late open position of the clip or clamp 16 with correspondingly large spacing X2 from the shed or the selvage.

Figure 4:
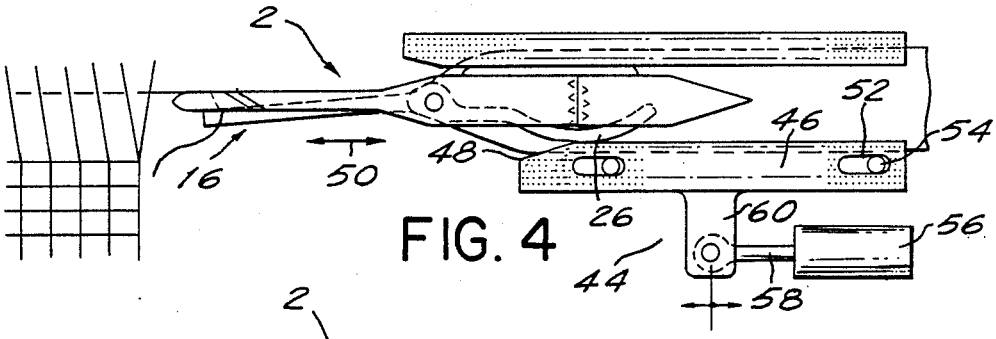
FIG. 4 is a view similar to FIG. 2 of a picker-gripper with a modified adjustment device.

FIG. 4 shows an additional embodiment of an adjustment apparatus 44 which comprises a control trip 46 cooperating a stop cam 26 of the clip or clamp 16. The control strip is equipped with a stop cam 48 and is displaceable in the operational direction 50 of the picker-gripper 2. For this purpose, the control strip 46 is supported on a bolt 54 by means of elongated holes 52. The control strip is displaced by a fluid actuated piston cylinder arrangement 56, whose piston rod 58 is articulated at an arm 60 of the control strip 46. Control of the adjustment apparatus 44 can occur in various ways which are not depicted in detail, but are analogous the above.

Figure 5:
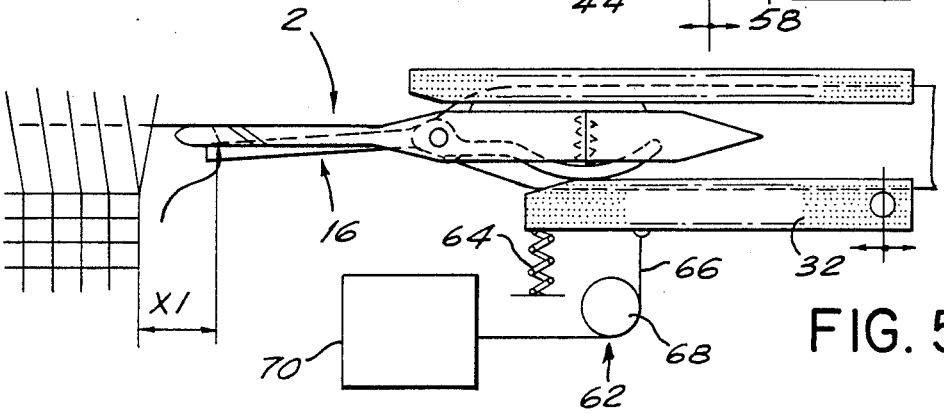
FIG. 5 is a view similar to FIG. 2 of a picker-gripper with an additional adjustment device.

FIG. 5 shows another embodiment of an actuation apparatus 62 which is designed similarly to the embodiment in FIGS. 2 and 3, wherein, however, the control strip 32 is biased by a spring against the picker-gripper 2 or its clip 16. A traction element organ 66, for instance, a cord belt or the like, is connected to the control strip 32, which cord is led over a redirection roller 68 to a control apparatus 70 of the gripper loom. The control apparatus can, for instance, be a shedding device controlled by a microprocessor, for instance, a Jacquard device, wherein a control string of the device is connected to the traction member 66. The microprocessor can then control the control string and thus the adjustment apparatus as a function of the rpm of the gripper loom.

While specific embodiments of the invention have been shown and described in detail to illustrate the application of the inventive principles, it will be understood that the invention may be embodied otherwise without departing from such principles.

What is claimed is:

1. A gripper loom comprising:

a gripper mounted for movement to insert a filling thread into a shed formed by warp threads;

a clip mounted to said gripper for holding a filling thread to said gripper while said gripper inserts the filling thread into the shed;

opening means operatively connected to said clip for moving said clip to release the filling thread from said gripper; and adjustment means operatively connected to said opening means for adjusting during loom operation a spacing between said gripper and the warp threads at which said opening means moves said clip to release the filling thread.

2. A gripper loom according to claim 1, wherein said adjustment means comprises a control strip mounted for pivotal movement near said gripper, said clip having a stop cam engageable against said control strip with movement of said gripper to move said clip to release a filling thread, said control strip being pivotable to selected pivotal positions for changing the spacing between said gripper and the warp threads at which said clip is moved to release the filling thread.

3. A gripper loom according to claim 1, wherein said adjustment means comprises a control strip mounted for linear movement near said gripper and in a direction substantially parallel to the direction of movement of said gripper, said control strip and said clip both including stop cams engageable with each other for moving said clip to release a filling thread with movement of said gripper, the linear position of said control strip being adjustable to change the spacing between said gripper and the warp threads at which said clip is moved to release a filling thread.

4. A gripper loom according to claim 1, wherein said clip includes a stop cam, said adjustment means including a movably mounted control strip mounted in a path of movement of said stop cam, and drive means connected to said control member for moving said control member to change the position of engagement between said control member and said stop cam to change the spacing between said gripper and the warp threads at which said clip is moved.

5. A gripper loom according to claim 4, including a motor connected to said drive means for turning said drive means to move said control member.

6. A gripper loom according to claim 1, wherein said adjustment means comprises a control member mounted for movement adjacent said gripper, said clip having a stop cam engageable with said control member for moving said stop cam to release the filling thread, and drive means connected to said control member for moving said control member to change the spacing between said gripper and the warp threads at which said clip is moved.

7. A gripper loom according to claim 6, wherein said drive means comprises a linear motor.

8. A gripper loom according to claim 7, wherein said linear motor comprises a piston and cylinder combination.

9. A gripper loom according to claim 6, wherein said drive means comprises a shedding device having a traction element connected to said control member for moving said control member.

10. A gripper loom according to claim 9, wherein said traction element comprises a cable, said shedding device having control means for moving said cable according to a preselected program.

11. A gripper loom according to claim 10, including biasing means for biasing said control member toward one direction of movement, said cable moving said control member in an opposite direction of movement.

* * * * *